US011667447B2

(12) United States Patent
Patton

(10) Patent No.: US 11,667,447 B2
(45) Date of Patent: Jun. 6, 2023

(54) CAN RETAINING APPARATUS AND ADVERTISING PLATFORM

(71) Applicant: Tommy L. Patton, Oak Glen, CA (US)

(72) Inventor: Tommy L. Patton, Oak Glen, CA (US)

( * ) Notice: Subject to any disclaimer, the term of this patent is extended or adjusted under 35 U.S.C. 154(b) by 43 days.

(21) Appl. No.: 17/315,658

(22) Filed: May 10, 2021

(65) Prior Publication Data

US 2022/0355992 A1 Nov. 10, 2022

(51) Int. Cl.

*B65D 71/50* (2006.01)
*G09F 23/00* (2006.01)
*B65D 71/00* (2006.01)

(52) U.S. Cl.

CPC ..... *B65D 71/50* (2013.01); *B65D 71/0085* (2013.01); *G09F 23/00* (2013.01)

(58) Field of Classification Search

CPC ..... B65D 71/50; B65D 71/0085; G09F 23/00
See application file for complete search history.

(56) References Cited

U.S. PATENT DOCUMENTS 1,456,401 A * 5/1923 Powell ..... G09F 5/04 206/391
2,514,858 A * 7/1950 Gray ..... B65D 71/44 294/87.2
3,016,136 A * 1/1962 Poupitch ..... B65D 71/504 206/820
3,046,711 A 7/1962 Harrison
3,094,210 A 6/1963 VanDenBerg
3,136,419 A * 6/1964 Ruderian ..... A63B 47/00 206/315.9
3,137,109 A 6/1964 Rapata
3,172,234 A 3/1965 Eavis
3,383,827 A 5/1968 Schaich
4,136,772 A 1/1979 Mascia et al.
4,236,638 A * 12/1980 Griffith ..... A47G 23/0266 206/427
4,312,449 A * 1/1982 Kinderman ..... A47F 5/0884 206/466
4,463,844 A 8/1984 Huffman et al.
4,651,873 A * 3/1987 Stolcenberg ..... B65D 71/50 206/427
4,664,255 A * 5/1987 Griffith ..... B65D 73/0007 206/427

(Continued)

*Primary Examiner* — Jacob K Ackun

(57) ABSTRACT

A can retaining apparatus and advertising platform comprising a strip with an upper surface, a lower surface and a perimeter edge. The strip is preferably rectangular shaped and can be made of various materials including polyethylene terephthalate (PET), polyethylene terephthalate glycol (PET G), plastic, metal, wood, rubber, fabric, vinyl, cardboard or a composite. Located on the strip is at least one, and preferably multiple retaining members, configured as an arrow structure within an oval opening, and onto which a can is secured and captively held. Also, on the strip is at least one, and preferably multiple, advertising sections. Each advertising section is configured to display product or promotional information from a company or organization. The advertising sections are either printed on, or are a substrate attached by attachment means, such as adhesive. A scannable image on the strip allows information to be stored and transferred to a person using the apparatus and platform.

8 Claims, 10 Drawing Sheets

(56) References Cited

U.S. PATENT DOCUMENTS

| | | | | | |
|---|---|---|---|---|---|
| 4,667,827 | A * | 5/1987 | Calcerano | B65D 73/0021 | 206/483 |
| 4,712,680 | A | 12/1987 | Panazzolo | | |
| 4,778,210 | A * | 10/1988 | Paulson | B65D 67/02 | 206/427 |
| 4,883,169 | A * | 11/1989 | Flanagan, Jr. | B65D 71/0003 | 206/202 |
| 4,930,829 | A * | 6/1990 | Paulson | B65D 67/02 | 206/427 |
| 5,267,427 | A | 12/1993 | Peterson et al. | | |
| 5,285,892 | A | 2/1994 | Adami et al. | | |
| 5,501,322 | A * | 3/1996 | Drebushenko | B65D 71/50 | 294/87.2 |
| 6,092,656 | A * | 7/2000 | Ernst | B25H 3/06 | 206/378 |
| 6,382,439 | B1 * | 5/2002 | Belokin | A63B 21/072 | 482/106 |
| 11,124,341 | B2 * | 9/2021 | Patton | B65D 71/504 | |
| 2006/0243632 | A1 * | 11/2006 | Trahan | B65D 1/34 | 206/557 |

* cited by examiner

CAN RETAINING APPARATUS AND ADVERTISING PLATFORM

TECHNICAL FIELD

The invention generally pertains to item retaining structures that display advertising, and more particularly, to an apparatus for retaining cans, such as beverage cans, that also provides multiple areas where advertising indicia is placed and displayed.

BACKGROUND ART

Of all the consumer based materials that are recyclable, aluminum and in particular aluminum cans, is the most recycled item in the United States. Every minute an average of 123,097 aluminum cans are recycled. On average, Americans recycle approximately two out of every three aluminum cans that are used, with about 65% of aluminum in the United States being recycled. This results in a typical aluminum can containing more than 50% post-consumer recycled aluminum.

Almost 75% of all aluminum produced in the United States is still in use today. Aluminum cans are 100% recyclable, which means that the full amount of aluminum that is recycled ends up back in use within 90 days. Also, there is no limit to how many times an aluminum can is able to be recycled, although when an aluminum can is repeatably recycled, the quality of the aluminum reduces.

Recycling a single aluminum can saves enough energy to run a 100 watt light bulb for 20 hours, a computer for 2 hours, or a television for 2 hours. Even though the benefits of recycling aluminum cans are well known, and aluminum is the most valuable recyclable material, many aluminum cans are still discarded and end up in landfills. In the United States, nearly $1 billion worth of aluminum cans are thrown away each year.

There are multiple reasons that some people do not recycle their used aluminum cans. First off, in order to be recycled aluminum cans must be separated from other recyclable and non-recyclable items. If the end user/consumer does not do this, then a recycling facility must. The sorting of aluminum cans is both time consuming and costs money. Further, for many individuals, recycling aluminum cans requires too much time and effort. Used aluminum cans must be stored somewhere, which requires space. The cans then have to be transported to a recycling facility, which are often viewed as dirty places that are best avoided. Also, when handling and transporting used aluminum cans, the residual beverage within a can often escapes and leaves a sticky mess on surfaces, in bags, and in vehicles. Even for people who care about the redemption payment received from recycling aluminum cans, the work and hassle is not worth the payout.

What is needed is a way of collecting, storing and transporting aluminum cans for recycling that allows a person to quickly, easily and cleanly handle multiple aluminum cans. Optimally, there would be a device or apparatus that in addition to maintaining/holding multiple aluminum cans, could itself be made of a recyclable material such as aluminum or plastic. Also, by incorporating other financial incentives such as advertising, more companies or organizations would be willing to support and participate in a recycling program.

A search of the prior art did not disclose any literature or patents that read directly on the claims of the instant invention. However, the following U.S. patents are considered related:

| U.S. Pat. No. | INVENTOR | ISSUED |
|---|---|---|
| 4,136,772 | Mascia, et al | Jan. 30, 1979 |
| 5,267,427 | Peterson, et al | Dec. 7, 1993 |
| 5,285,892 | Adami, et al | Feb. 15, 1994 |

The U.S. Pat. No. 4,136,772 patent discloses a reusable carrier for cans which comprises a thin sheet of resilient plastic material with can-receiving frusto-conical openings having wide bottom ends and narrow upper ends permitting application of the carrier onto the cans by a single press-on operation.

The U.S. Pat. No. 5,267,427 patent discloses a recycling strip for holding, storing, toting, and returning empty recyclable plastic bottles. The strip has a plurality of collar holes distributed uniformly and unilinearly along the strip. The collar holes have a diameter slightly larger than the outside diameter of a plastic bottleneck. The collar holes have radial slits forming collars which enable a bottleneck flange to be engaged in the strip. The strip is then used for transporting engaged bottles and can be recycled with the bottles. The strip may be loaded in a dispenser which provides a convenient means of storing the strip.

The U.S. Pat. No. 5,285,892 patent discloses can carriers with upwardly protruding can-receiving members having oppositely paired can-receiving recesses and can-stacking platforms. The recesses are defined by an annular locking ring joined to a protective inverted cup-shaped cover wall sized and configured to closely correspond to the top bead of a conventional can. The locking run thus seats below the top bead of the can thereby removably locking the can to the can carrier. Paired finger openings are preferably provided in association with a raised pad region.

For background purposes and indicative of the art to which the invention relates, reference may be made to the following remaining patents found in the patent search.

| U.S. Pat. No | INVENTOR | ISSUED |
|---|---|---|
| 3,046,711 | Harrison | Jul. 31, 1962 |
| 3,094,210 | VanDenBerg | Jun. 18, 1963 |
| 3,137,109 | Rapata | Jun. 16, 1964 |
| 3,172,234 | Burford | May 2, 1967 |
| 3,383,827 | Schaich | May 21, 1968 |
| 4,463,844 | Huffman, et al | Aug. 7, 1984 |
| 4,712,680 | Panazzolo | Dec. 15, 1987 |

DISCLOSURE OF THE INVENTION

A can retaining apparatus and advertising platform that allows at least one, and preferably multiple, aluminum beverage cans to be captively held on the apparatus for storage, transportation and eventual recycling. The apparatus and platform comprise a strip with an upper surface, a lower surface and a perimeter edge. On the strip there is at least one, and preferably multiple, can retaining members. Onto each retaining member a can is secured and captively held. There is also at least one, and preferably multiple, sections configured to display product or promotional information, which is printed onto or attached by attachment means such as adhesive, onto at least one strip surface.

The strip can be made of various materials, including polyethylene terephthalate (PET), polyethylene terephthalate glycol (PET-G), plastic, metal, wood, rubber, fabric, vinyl, cardboard or a composite. Each of the retaining members comprises an oval opening configured with an inner perimeter edge, with a tab extending downward from the perimeter edge. At a distal end of the tab a first angled leg extends upward at substantially forty-five degrees, and a second angled leg extends upward at substantially forty-five degrees from an opposite direction to the first angled leg. This creates a retaining member configured as an arrow terminating at a point within the oval opening. To provide flexing of the arrow, a slit extends upward from the arrow point.

The strip can be packaged with a group of cans, either on an upper surface, a lower surface, or a side surface. To allow the strip to be easily carried, at least one handle is included, with a handle placed at an end of the strip, which is preferably rectangular shaped.

In view of the above disclosure, the primary object of the invention is to provide a can retaining apparatus and advertising platform that allows at least one and preferably multiple aluminum cans to be easily secured onto a strip, transported to a desired location and eventually recycled. Advertising indicia on the strip provides a monetary incentive for companies or organizations to support the use of the strip.

In addition to the primary object of the invention it is also an object of the invention to provide a can retaining apparatus and advertising platform that:

- is easy to use, for men and women, adults and children,
- can be made of a material that is recyclable either along with aluminum cans or separately,
- can be sold as a for-profit consumer product, or given away as an incentive to recycling,
- can be easily cleaned and re-used numerous times,
- is lightweight yet robust and long-lasting,
- can retain most aluminum cans including small and oversized cans,
- can potentially have a significant impact on the environment,
- can be an effective revenue boosting means,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
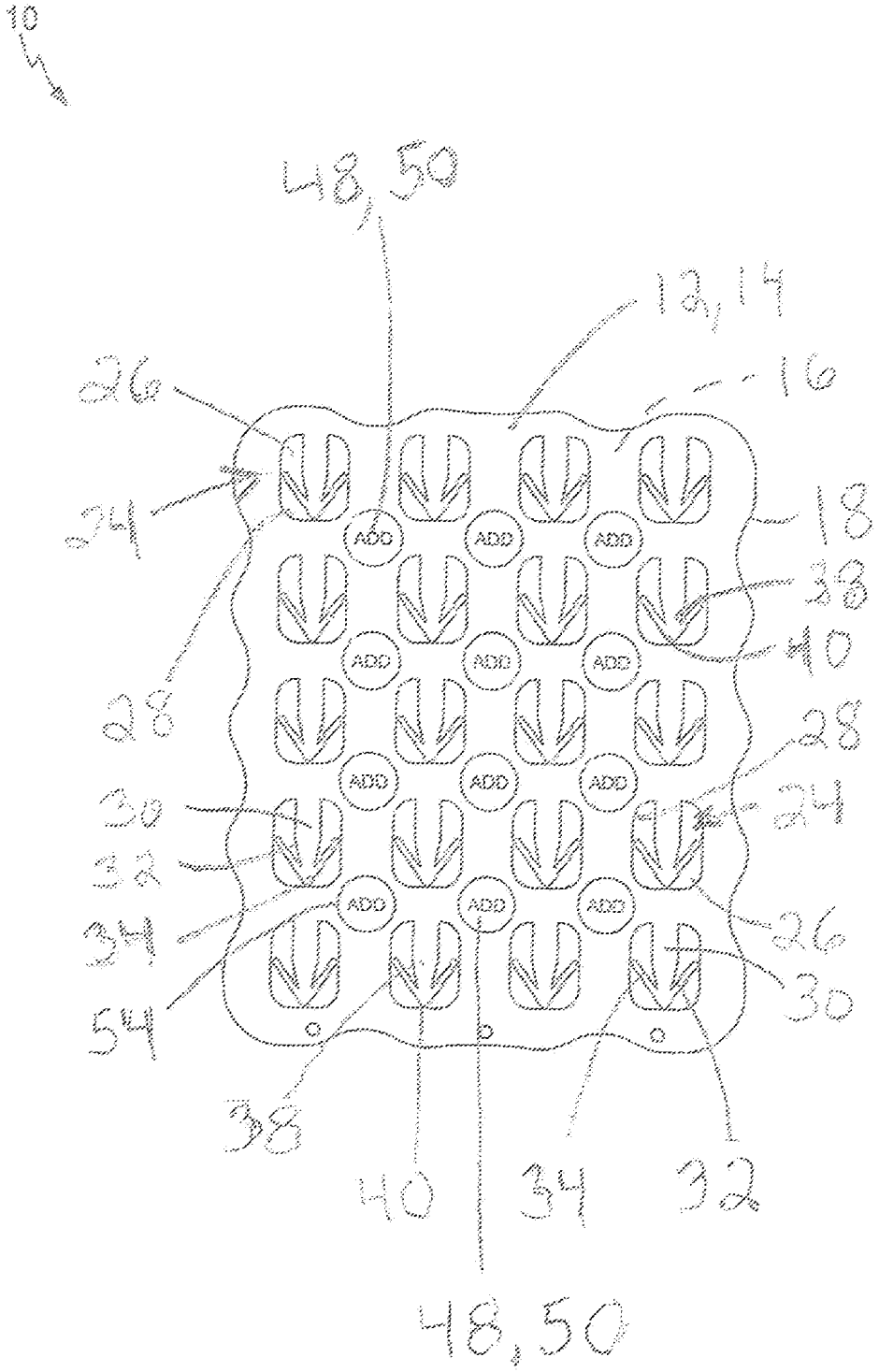
FIG. 1 is a top plan view showing a can retaining apparatus and advertising platform (apparatus and platform) strip with attached advertising sections.
Figure 2:
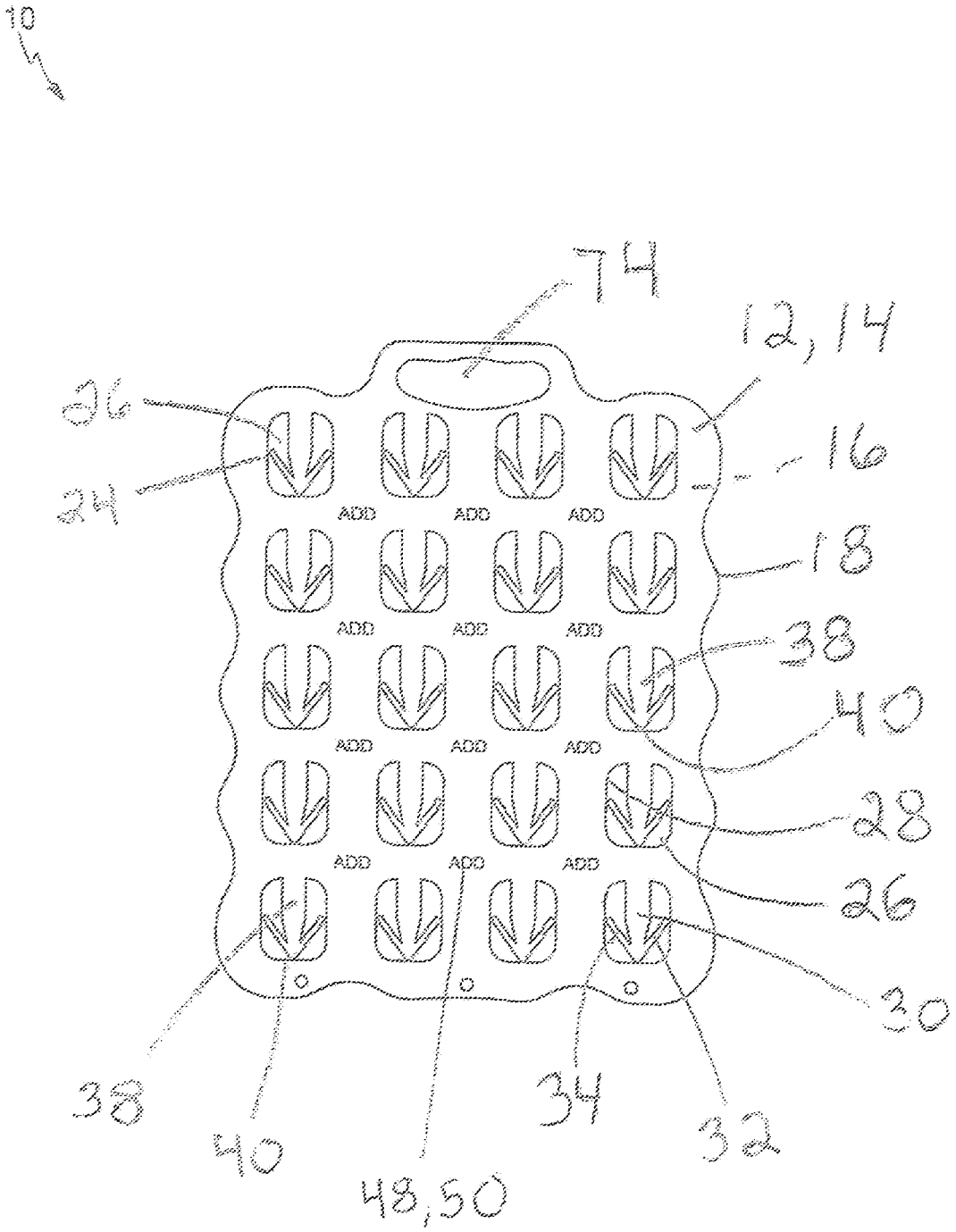
FIG. 2 is a top plan view showing the apparatus and platform strip with printed advertising sections and with a handle.
Figure 3:
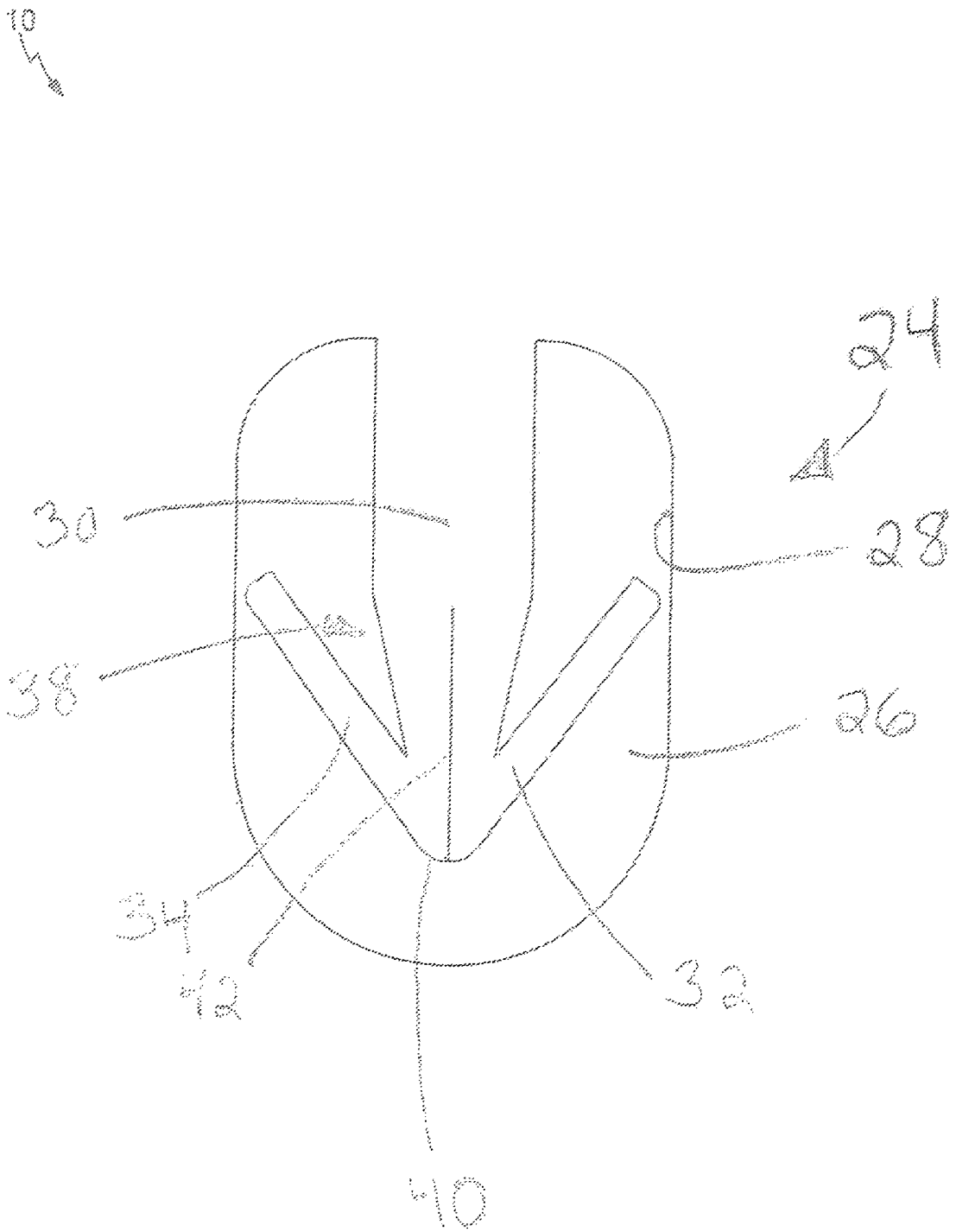
FIG. 3 is a top plan detail view showing one of the apparatus and platform strip's retaining members with an arrow structure within an oval opening.

The best mode for carrying out the invention is presented in terms that disclose a preferred embodiment of a can retaining apparatus and advertising platform. Of all recyclable materials, aluminum, and particularly aluminum cans, is the most recycled. Over fifty-percent of aluminum cans in the United States are recycled, and aluminum cans are able to be recycled multiple times. While there are many benefits of recycling aluminum cans, some people choose not to recycle their cans. The aluminum cans that are not recycled typically are just thrown away with other garbage and end up in a landfill. The major reasons for not recycling are that aluminum cans must be separated/sorted from other recyclable and non-recyclable materials, collecting, storing and transporting aluminum cans is often time consuming, space requiring, and, if sugar-based beverages were originally in the cans, the result can be a bunch of dirty, sticky cans that must be dealt with. Many people have a less than positive opinion of recycling facilities and prefer not to go to the facilities.

The can retaining apparatus and advertising platform (the apparatus and platform 10), as shown in FIGS. 1-10, offers a solution to these problems by providing a means by which an individual can quickly and easily maintain a quantity of aluminum cans on a single, lightweight and clean device. The cans are easily secured onto and removed with a minimal amount of interaction with a person using the device. The inclusion of advertising provides a strong monetary inventive for individuals, companies and organizations to support the use of the apparatus and platform 10.

As shown in FIGS. 1-10, the apparatus and platform 10 is comprised of a strip 12 with an upper surface 14, a lower surface 16 and a perimeter edge 18. The strip 12 is preferably rectangular shaped, although other shapes could also be utilized. The strip 12 can be made of various materials including plastic, metal, wood, rubber, fabric, vinyl, cardboard, or a composite, with polyethylene terephthalate (PET), polyethylene terephthalate glycol (PET-G) preferred.

Figure 4:
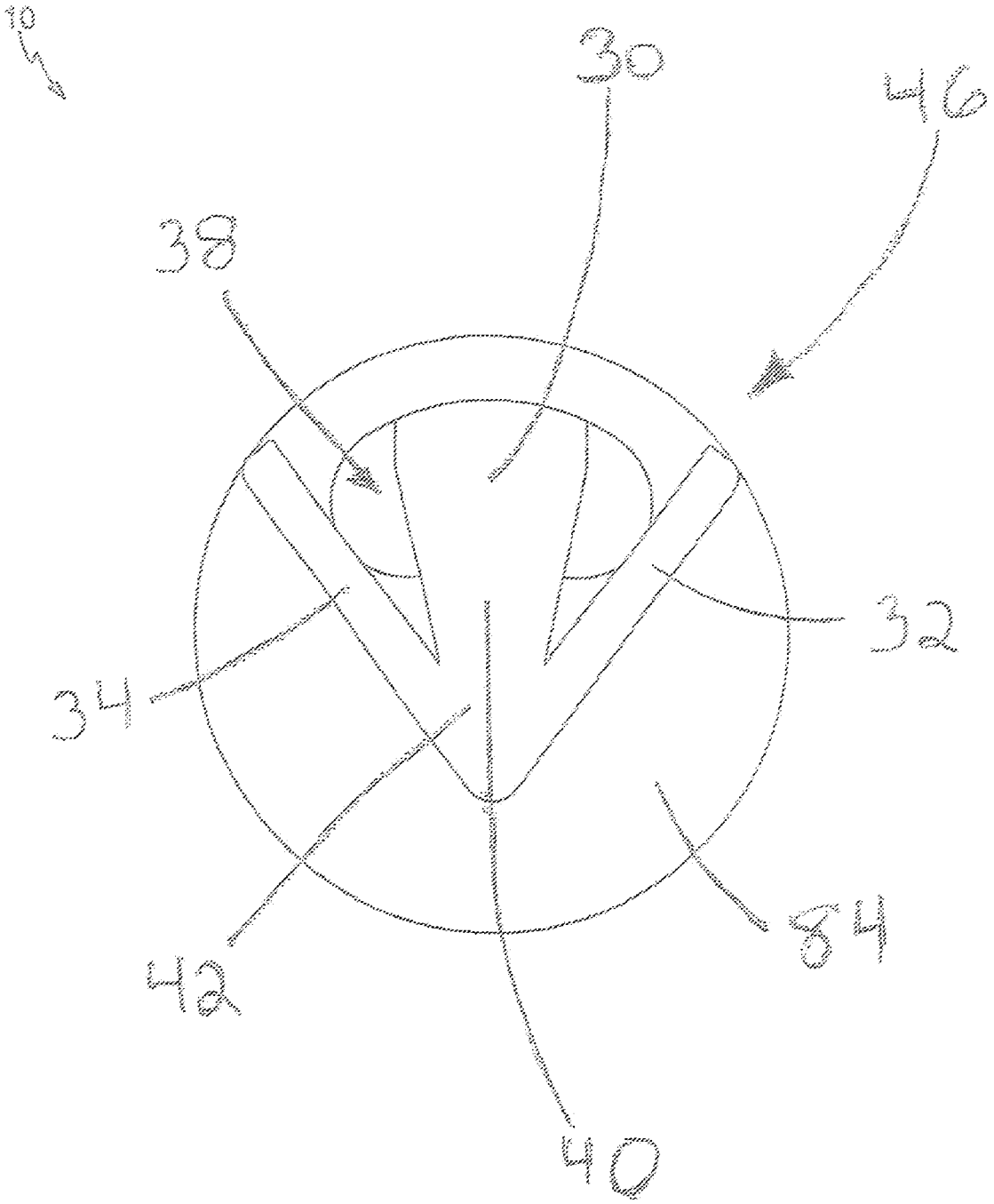
FIG. 4 is an elevational interior view showing a can secured onto a retaining member arrow structure and the multi-engagement action that occurs when a can is secured.

On the strip 12 is at least one, and preferably multiple, retaining members 24, as shown in FIGS. 1-3 and 5-10. Each retaining member 24 is comprised of an oval opening 26 with an inner perimeter edge 28. Extending downward from the perimeter edge 28 is a tab 30. At a distal end of the tab 30, a first angled leg 32 extends upward at substantially forty-five degrees, and a second angled leg 34 extends upward at substantially forty-five degrees from an opposite direction the first leg 32. This forms a retaining member 24 configured as an arrow 38 terminating at a point 40 within the oval opening 26. A can 84 is secured onto, and captively held on the retaining member 24 by inserting the retaining member arrow into the opening on the upper surface of the can. A slit 42 extends upward from the arrow point to allow the arrow to flex as a can is secured onto the retaining member 24 when the can 84 is secured onto the retaining member 24, with the arrow through the can opening, a multi-engagement locking action 46 occurs, as shown in FIG. 4. While the retaining member 24 has an oval shaped opening, other shapes such as circular could also be used.

Figure 5:
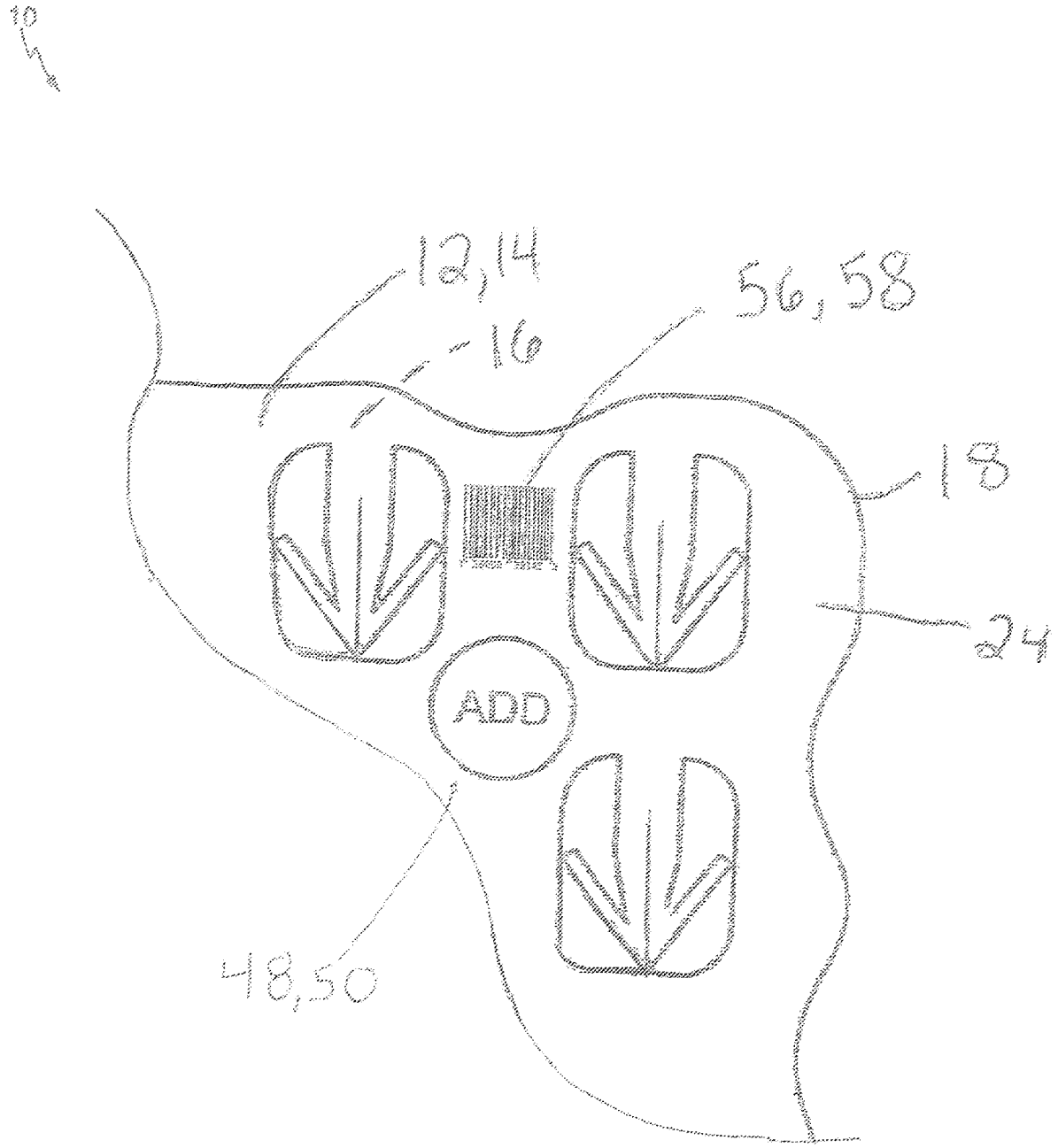
FIG. 5 is a top plan detail view showing the strip with a scannable image in the form of a universal product code (barcode).
Figure 6:
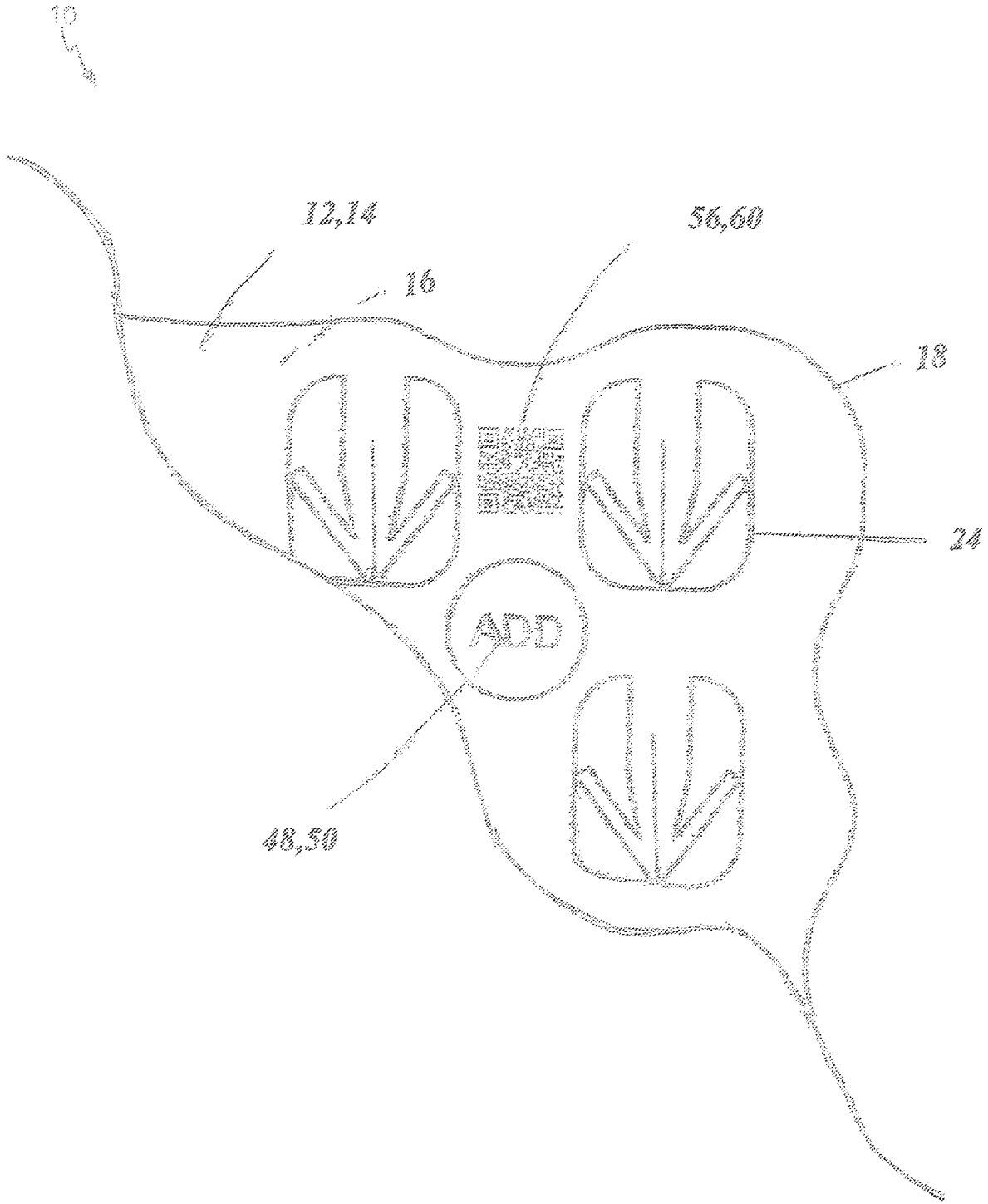
FIG. 6 is a top plan detail view showing the strip with a scannable image in the form of a Quick Response (QR) code.
Figure 7:
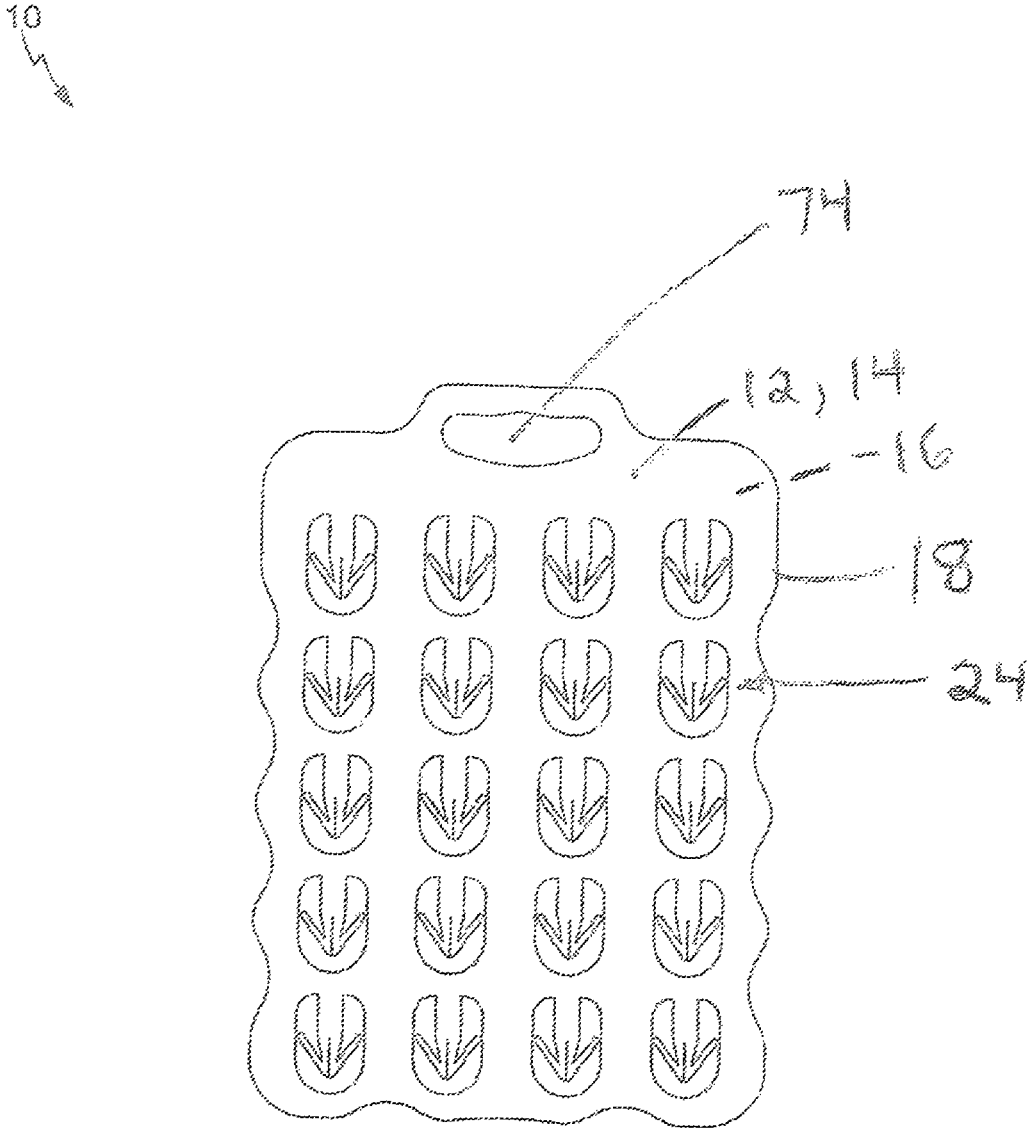
FIG. 7 is a top plan view showing the apparatus and platform strip with no advertising section(s).

Located on at least one of the strip's surfaces 14,16 is at least one, and preferably multiple, advertising sections 48, as shown in FIGS. 1, 2, 5 and 6. Each advertising section 48 is configured to display product or promotional information 50, which is printed onto the strip surface or attached by an attachment means 54 such as an adhesive, onto the surface. It should be noted that while the invention is named a Can Retaining Apparatus and Advertising Platform, the functionality of the strip 12 for retaining cans does not require the use/inclusion of advertising. A strip 12 without advertising, as shown in FIG. 7, is fully capable of retaining cans for many different purposes, As shown in FIGS. 5 and 6, in order to provide storage and transfer of information either pertaining to a user of the apparatus and platform 10 or information related to a company or organisation shown on one (or more) of the advertising sections 48, a scannable image 56 is printed onto or attached onto a surface of the strip 12. The scannable image 56 can be comprised of a Universal Product Code (barcode) 58, as shown in FIG. 5, a Quick Response (QR) code 60, as shown in FIG. 6, a series of digits (not shown), a series of letters (not shown) or a series of combined digits and letters (not shown). Optimally, the scannable image 56 will allow a person to use a wireless device such as a smartphone, to scan the image to receive or transfer information such as how many cans are being recycled, how many times a particular strip has been used, and/or how much money has been accrued from the recycled cans. Also, the advertisers can have coupons, company information or promotions transferred to a person's smartphone via the scannable image.

Figure 8:
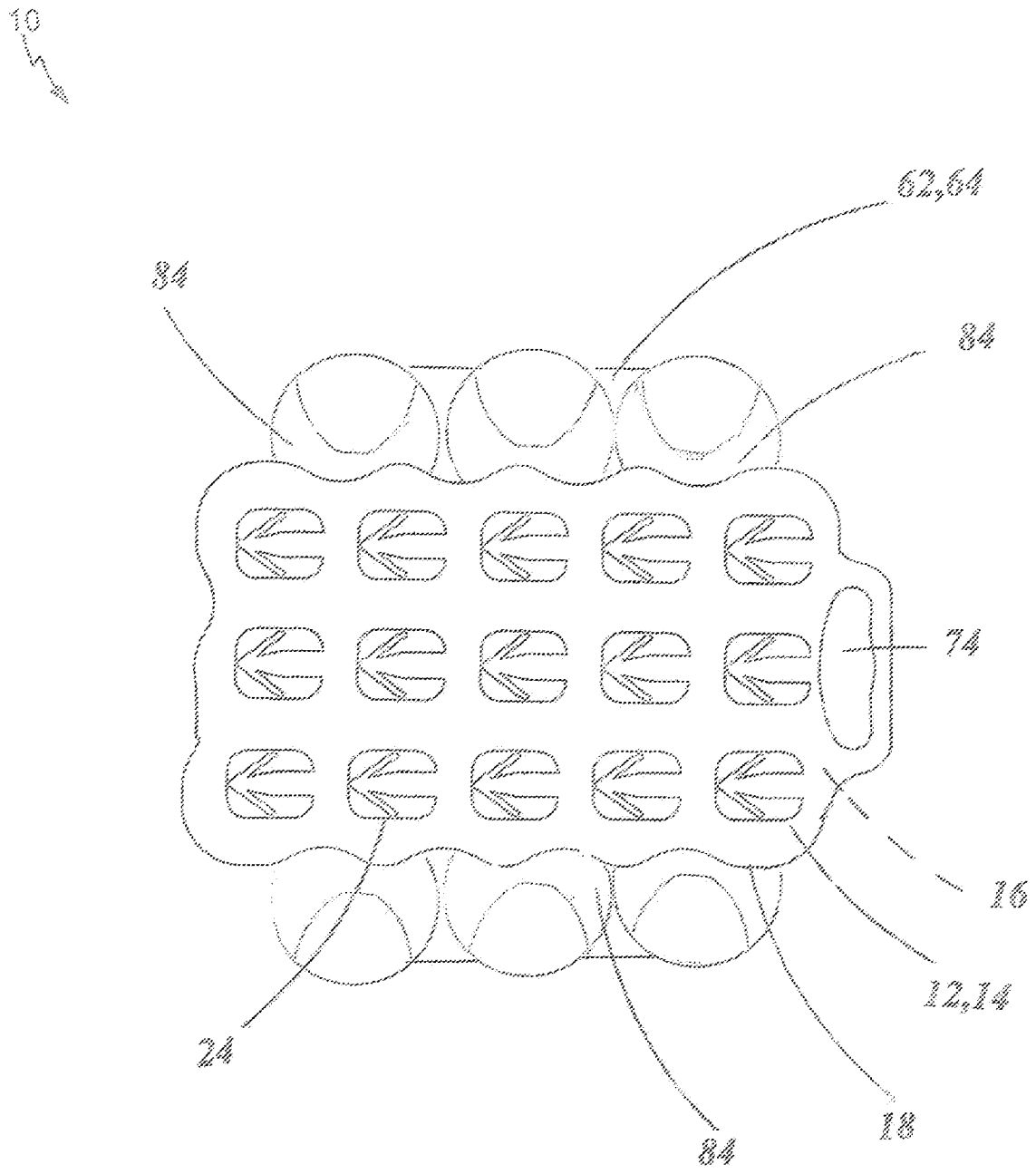
FIG. 8 is a top plan view showing a group of cans with a strip attached to an upper surface of the group of cans.
Figure 9:
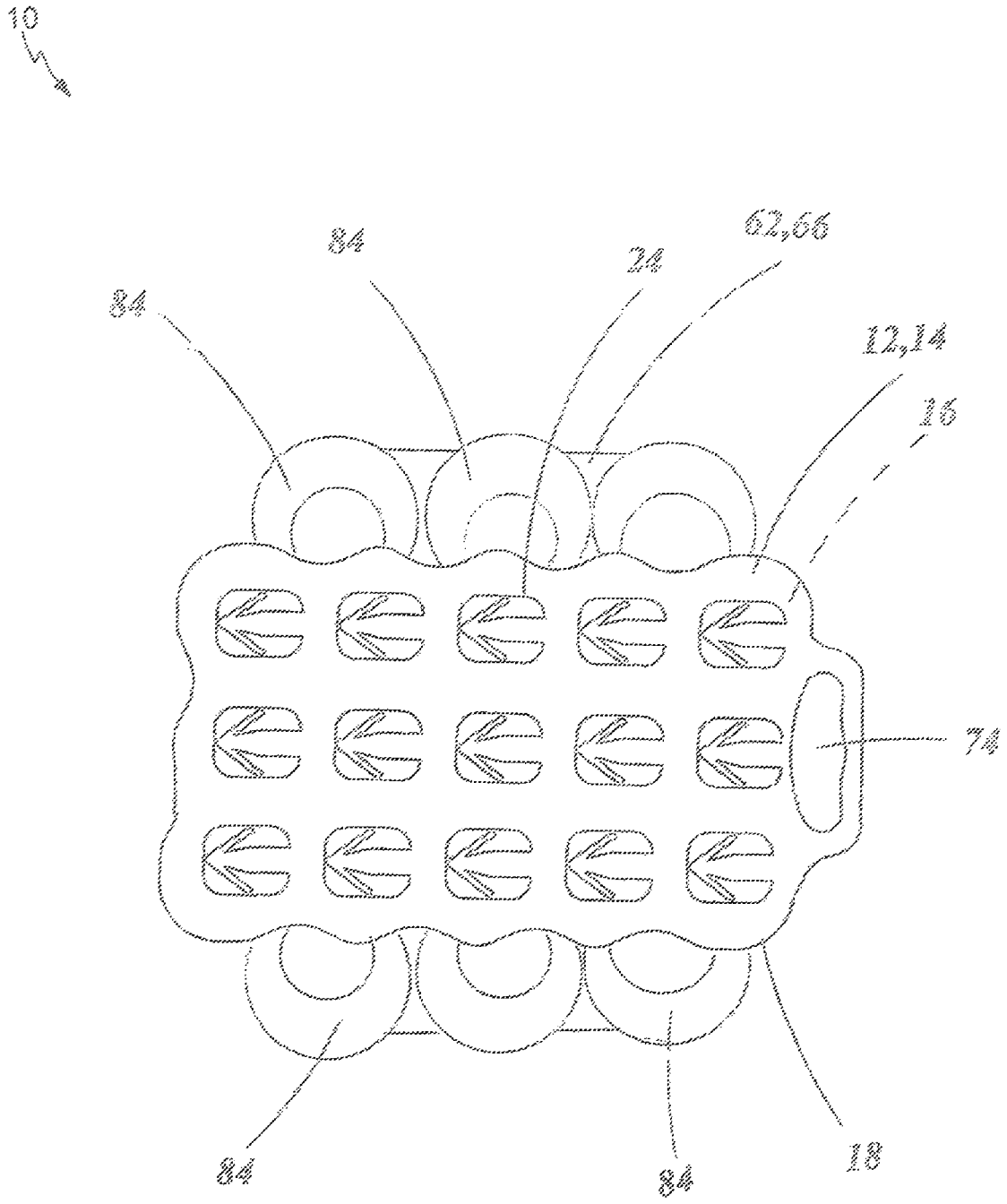
FIG. 9 is a top plan view showing a group of cans with a strip attached to a lower surface of the group of cans.
Figure 10:
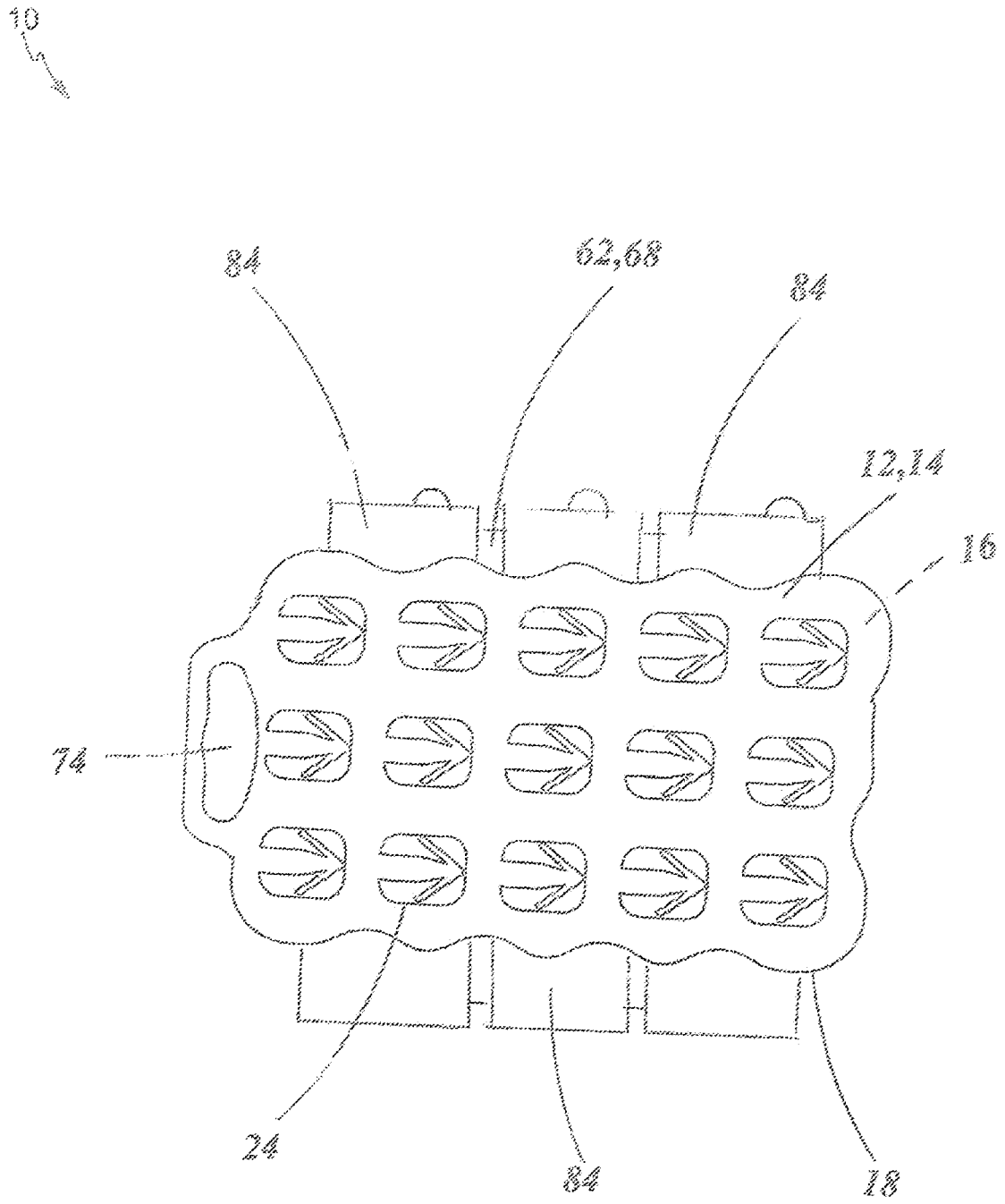
FIG. 10 is an elevational side view showing a group of cans with a strip attached to a side surface of the group of cans.

The apparatus and platform 10 can be provided one at a time by hand or multiple strips 12 can be rolled together and one or more strips removed from the roll as needed. The multiple strips can be held together end to end, with serrations separating each strip 12, allowing each strip to be easily torn away/off the roll. Also, at least one strip 12 can be included along with a packaged group of cans 62, as shown in FIGS. 8-10. A strip 12 can be placed on an upper surface 64, as shown in FIG. 8, a lower surface 66, as shown in FIG. 9, and/or a side surface 68, as shown in FIG. 10, of a packaged group of cans.

To allow the strip 12 to be easily gripped and carried, at least one handle 74 is utilized. As shown in FIGS. 2 and 7-10, the handle 74 extends outward from an end of the strip 12. It should be noted that while the preferred embodiment of the apparatus and platform 10 has been disclosed, and certain features are envisioned such as twenty retaining members are twenty-four advertising sections, the design and functionality of the apparatus and platform 10 can be easily altered to facilitate use with any type or size of can.

While the invention has been described in detail and pictorially shown in the accompanying drawings it is not to be limited to such details, since many changes and modifications may be made to the invention without departing from the spirit and the scope thereof. Hence, it is described to cover any and a modifications and forms which may come within the language and scope of the claims.

The invention claimed is:

1. A can retaining apparatus and advertising platform comprising a strip comprising an upper surface, a lower surface, a perimeter edge, and at least one retaining member onto which a can is secured and captively held, the at least one retaining member comprises an oval opening configured with an inner perimeter edge, with a tab extending downward from the perimeter edge, at a distal end of the tab a first angled leg extends upward at substantially forty-five degrees, and a second angled leg extends upward at substantially forty-five degrees from an opposite direction to the first angled leg, thereby forming a retaining member configured as an arrow terminating at a point within the oval opening, and having a slit extending upward from the arrow point at least one advertising section configured to display product or promotional information is printed onto or attached by attachment means onto at least one strip surface, the strip material is selected from the group consisting of polyethylene terephthalate (PET), polyethylene terephthalate glycol (PET G), plastic, metal, wood, rubber, fabric, vinyl, cardboard and a composite, and the strip baying twenty retaining members.

2. A can retaining apparatus and advertising platform comprising:

a strip comprising an upper surface, a lower surface and a perimeter edge, at least one retaining member into which a can is inserted and captively held, the retaining member comprising an oval opening with an inner perimeter edge, with a tab extending downward from the perimeter edge, wherein at a distal end of the tab a first angled leg extends upward at substantially forty-five degrees, and a second angled leg extends upward at substantially forty-five degrees from an opposite direction to the first angled leg, thereby forming a retaining member configured as an arrow terminating at a point within the oval opening, and having a slit extending upward from the arrow point, at least one advertising section configured to display product or promotional information, that is printed onto or attached by attachment means onto at least one strip surface, and at least one handle extending outward from the strip perimeter edge.

3. The can retaining apparatus and advertising platform of claim 2, wherein the strip material is selected from the group consisting of polyethylene terephthalate (PET), polyethylene terephthalate glycol (PET G), plastic, metal, wood, rubber, fabric, vinyl, cardboard and a composite.

4. The can retaining apparatus and advertising platform of claim 2, wherein the strip having twenty retaining members.

5. The can retaining apparatus and advertising platform of claim 2, wherein the attachment means for attaching the substrate is comprised of an adhesive.

6. The can retaining apparatus and advertising platform of claim 2, wherein when a can is secured onto the retaining member, a multi-engagement locking action occurs.

7. The can retaining apparatus and advertising of claim 2, comprising twenty-four advertising sections.

8. The can retaining apparatus and advertising platform of claim 2, further comprising a scannable image that is selected from the group consisting of a Universal Product Code (barcode), a Quick Response (QR) code, a series of digits, a series of letters, and a series of combined digits and letters.

* * * * *